US008462001B2

(12) United States Patent
Morris

(10) Patent No.: US 8,462,001 B2
(45) Date of Patent: Jun. 11, 2013

(54) ENVIRONMENTAL ALARM SENSOR PANEL AND RELATED METHOD FOR A TELECOMMUNICATION CABLE STATION

(75) Inventor: Robert Bruce Morris, Riverside, RI (US)

(73) Assignee: Great Eastern Group, Inc., Fort Lauderdale, FL (US)

( * ) Notice: Subject to any disclaimer, the term of this patent is extended or adjusted under 35 U.S.C. 154(b) by 343 days.

(21) Appl. No.: 12/847,255

(22) Filed: Jul. 30, 2010

(65) Prior Publication Data

US 2012/0025994 A1 Feb. 2, 2012

(51) Int. Cl.
*G08B 17/00* (2006.01)

(52) U.S. Cl.
USPC ..... 340/584; 340/539.26; 340/539.27; 340/577

(58) Field of Classification Search
USPC ..... 340/584, 539.26
See application file for complete search history.

(56) References Cited

U.S. PATENT DOCUMENTS

| | | | | |
|---|---|---|---|---|
| 4,742,475 | A | 5/1988 | Kaiser et al. | |
| 5,293,755 | A | 3/1994 | Thomas | |
| 5,553,006 | A * | 9/1996 | Benda | 700/276 |
| 5,729,197 | A | 3/1998 | Cash | |
| 5,781,108 | A * | 7/1998 | Jacob et al. | 340/552 |
| 5,910,765 | A * | 6/1999 | Slemon et al. | 340/517 |
| 6,553,336 | B1 | 4/2003 | Johnson et al. | |
| 6,776,707 | B2 | 8/2004 | Koplin | |
| 6,788,535 | B2 | 9/2004 | Dodgen et al. | |
| 7,132,941 | B2 * | 11/2006 | Sherlock | 340/539.26 |
| 2005/0219048 | A1 * | 10/2005 | Kimmel et al. | 340/511 |
| 2006/0219147 | A1 * | 10/2006 | DeRosa | 114/203 |
| 2012/0109404 | A1 * | 5/2012 | Pandey et al. | 700/299 |

OTHER PUBLICATIONS

Winland Electronics, Inc., Humid Alert HA-1 Humidity Monitor, 2006, pp. 1-2, http://www.totalcomputing.net/assets/pdf/winland/Winland_HA1.pdf.*

* cited by examiner

*Primary Examiner* — Kerri McNally
(74) *Attorney, Agent, or Firm* — Capitol Patent & Trademark Law Firm, PLLC

(57) ABSTRACT

An environmental alarm sensor panel for a telecommunication cable station (TCS) is provided. The sensor panel can includes a plurality of alert sensors for measuring environmental conditions and other conditions in an equipment room of the TCS. The sensors are hard wired to an equipment interface panel for telecommunication equipment in the equipment room. The equipment interface panel is connected to the telecommunication equipment and is in communication with a network operation center (NOC), which is located remotely from the TCS and monitors the status of the TCS. According to an embodiment, the alarm sensor panel includes one or more dry contact temperature alert sensors, a humidity alert sensor, a smoke alert sensor and a power alert sensor. The sensors are configured to generate respective alert signals when selected conditions exist (e.g., the temperature of the equipment room is outside of one or more selected temperature ranges, the humidity of the equipment room is outside of a selected humidity range, smoke or fire is present, or a power source has come on or gone off). Monitoring equipment in the NOC is configured to detect and record the alert signals, and generates respective alarms in response to detecting the alert signals. Thus, the warrantor(s) of the telecommunication equipment and personnel in the TCS and/or NOC can have records of environmental breaches and data for any recourse on possible warranty claims and equipment failures.

13 Claims, 4 Drawing Sheets

ENVIRONMENTAL ALARM SENSOR PANEL AND RELATED METHOD FOR A TELECOMMUNICATION CABLE STATION

BACKGROUND

Telecommunication cable stations (TCSs) contain telecommunication equipment, such as computers, fiber optic digital distribution equipment and switches, that route and otherwise process voice and/or data signals in telecommunication networks. Certain environmental conditions must be maintained in equipment rooms of the cable stations in order to ensure that the telecommunication equipment functions safely, reliably and within manufacturer specifications. For example, the temperature and humidity of an equipment room must not be too high, smoke and fire must be prevented, and power surges must be avoided. For this reason, warrantors of the telecommunication equipment often require that certain environmental conditions be maintained in order for parts and/or service warranties on the telecommunication equipment to be valid.

In view of the above, warrantors of telecommunication equipment in TCSs have an interest in monitoring environmental conditions in equipment rooms of TCSs to obtain records of environmental breaches and data for any recourse on possible warranty claims and equipment failures. It is, therefore, desirable to provide simple, cost-effective devices, systems and methods for monitoring the environmental conditions of equipment rooms. It is further desirable to provide such devices, systems and methods that can be implemented with minimal changes to existing equipment, interfaces and software in TCSs.

SUMMARY

The disclosure relates to an environmental alarm sensor panel for a telecommunication cable station equipment room. The disclosure further relates to a monitoring system for a telecommunication cable station employing such a sensor panel, and a method for monitoring an environment of a telecommunication cable station equipment room using such a sensor.

According to an embodiment of the invention, a sensor panel includes a base panel member and a plurality of sensors mounted on the base panel member. The plurality of sensors can include one or more dry contact temperature alert sensors, a dry contact humidity alert sensor, a dry contact smoke alert sensor and a power alert sensor. The one or more temperature sensors are each configured to measure an environmental temperature and generate a temperature alert signal when the environmental temperature is outside of a selected temperature range. The humidity sensor is configured to measure an environmental humidity and generate a humidity alert signal when the environmental humidity is outside of a selected humidity range. The smoke alert sensor is configured to sense smoke and fire and generate a smoke alert signal upon sensing smoke or fire.

According to another embodiment of the invention, a monitoring system for a telecommunication cable station includes an environmental alarm sensor panel located in the cable station, and monitoring equipment located in a network operation center remote from the telecommunication cable station. The sensor panel can include a base panel member and a plurality of sensors mounted on the base panel member. The plurality of sensors can include: a one or more dry contact temperature alert sensors configured to measure an environmental temperature of an equipment room in the cable station and generate one or more temperature alert signals when the environmental temperature is outside one or more selected temperature ranges; a dry contact humidity alert sensor configured to measure an environmental humidity of the equipment room and generate a humidity alert signal when the environmental humidity is outside of a selected humidity range; and a dry contact smoke alert sensor configured to sense smoke and fire in the equipment room and generate a smoke alert signal upon sensing smoke or fire. The monitoring equipment is configured to generate one or more temperature alarms, a humidity alarm or a smoke alarm in response to receiving the one or more temperature alert signals, the humidity alert signal or the smoke alert signal, respectively.

According to yet another embodiment, a method for monitoring an environment of an equipment room in a telecommunication base station includes measuring a temperature of the room using at least one dry contact temperature sensor mounted on an alarm sensor panel, measuring a humidity of the room using a dry contact humidity sensor mounted on the sensor panel, sensing the air in the room to detect fire or smoke using a smoke sensor mounted on the sensor panel, and sensing the status of a power source for telecommunication equipment in the room using a power alert sensor mounted on the sensor panel. The method further includes generating at least one alert signal from the sensor panel in response to the temperature of the room being outside of at least one selected temperature range, the humidity of the room being outside of a selected humidity range, the presence of smoke or fire in the room, and/or the power source coming on or going off. Additionally, the method includes detecting the at least one alert signal using monitoring equipment in a network operation center located remotely from the telecommunication cable station, and generating at least one alarm from the monitoring equipment in response to the at least one alert signal. The at least one alarm includes an indication that the temperature of the room is outside of at least one selected temperature range, the humidity of the room is outside of a selected humidity range, smoke or fire is present in the room, and/or the power source has come on or gone off.

Other features and advantages of the invention will be apparent to those skilled in the art from the following detailed description, claims and appended drawings.

DETAILED DESCRIPTION

Referring to the appended drawing FIGS. 1-6B, in which like numerals refer to like elements throughout the several views, the disclosure concerns an environmental alarm sensor panel for an equipment room of a telecommunication cable station, a monitoring system employing the sensor panel and a method of monitoring the environment of the equipment room using the sensor panel. The sensor panel is configured to sense environmental conditions in the equipment room and generate alert signals indicating breaches of desired/required environmental conditions or conditions of concern for telecommunication equipment in the equipment room. Monitoring equipment in a network operating center, located remotely from the cable station, is configured to detect the alert signals and generate alarms notifying network operating center personnel, cable station personnel, and warrantors of the telecommunication equipment of the breaches or conditions of concern. The alarms can be recorded to provide the warrantors of the telecommunication equipment recourse for possible warranty claims and equipment failures.

Figure 1:
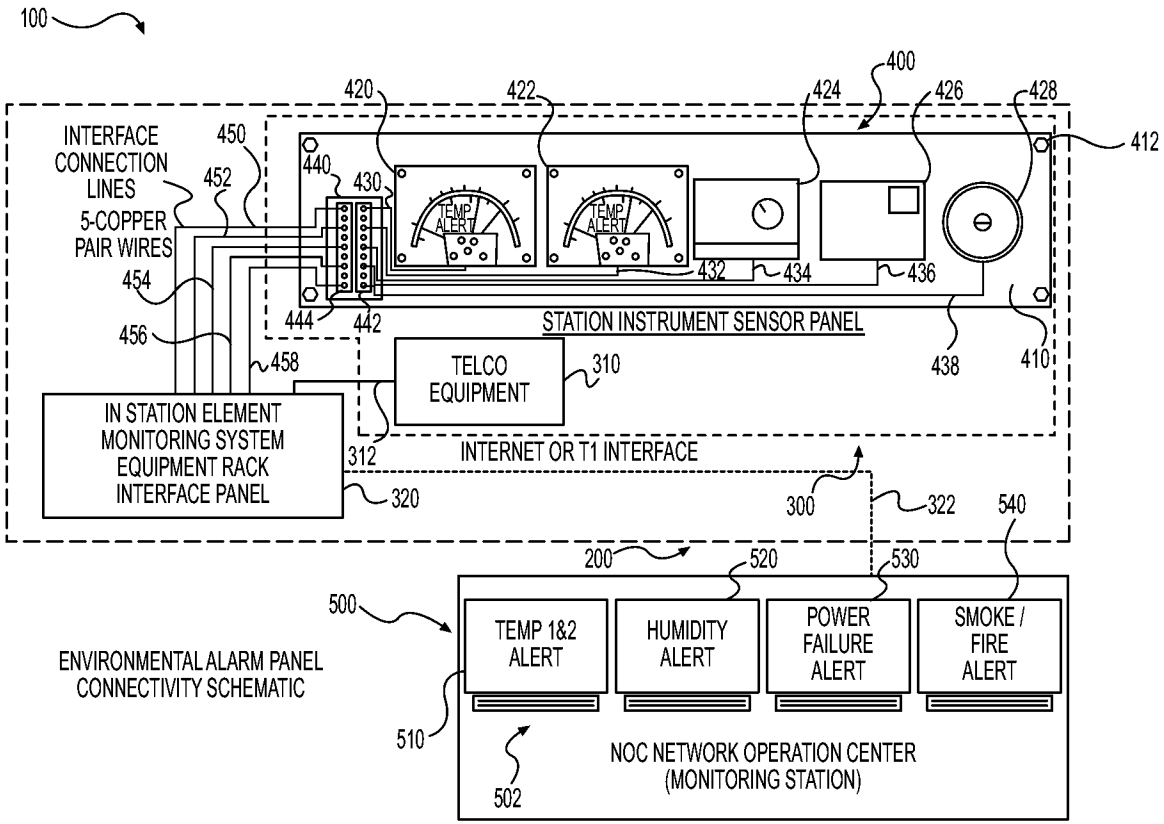
FIG. 1 is a schematic diagram showing the connectivity of an environmental monitoring system for a telecommunication cable station in a telecommunication network according to one embodiment of the invention.

FIG. 1 is a partial schematic diagram of a telecommunication network 100 providing voice and/or data service to network subscribers (not shown). The network 100 includes a telecommunication cable station (TCS) 200 for managing network signals and a network operating center (NOC) 500 typically located remotely from the TCS 200 and in communication with the TCS 200 for monitoring operation of the TCS 200.

The TCS 200 includes an equipment room 300 housing telecommunication equipment 310. The telecommunication equipment 310 can include switches, alarm interface panels and/or other devices, such as computers and fiber optic digital distribution equipment, that route or otherwise control or manipulate voice and/or data signals carried through the network 100. The equipment 300 can be mounted on one or more equipment racks (not shown), as is known in the art. The equipment 300 is connected to an equipment interface panel 320 in the TCS 200 by either wired or wireless connections 312, in a manner known in the art. The equipment interface panel 320 is typically in communication with the NOC 500 via a remote connection 322, which can be an internet connection, T1 connection or other suitable connection. It should be understood that, although only one equipment room 300 is shown in FIG. 1, the TCS 200 can include multiple equipment rooms 300, each housing various pieces of equipment 310.

The equipment 310 may be warranted against failure or malfunction as long as certain environmental conditions (e.g., temperature, humidity, lack of smoke/fire) are maintained in the equipment room 300. It is therefore important to have the ability to monitor and record environmental conditions of the equipment room 300 so that environmental information is available to the warrantors of the equipment 310 when considering warranty claims for equipment failure and malfunction. To this end, the TCS 200 includes an environmental alarm sensor panel 400 for sensing environmental conditions in the equipment room 300.

Figure 2:
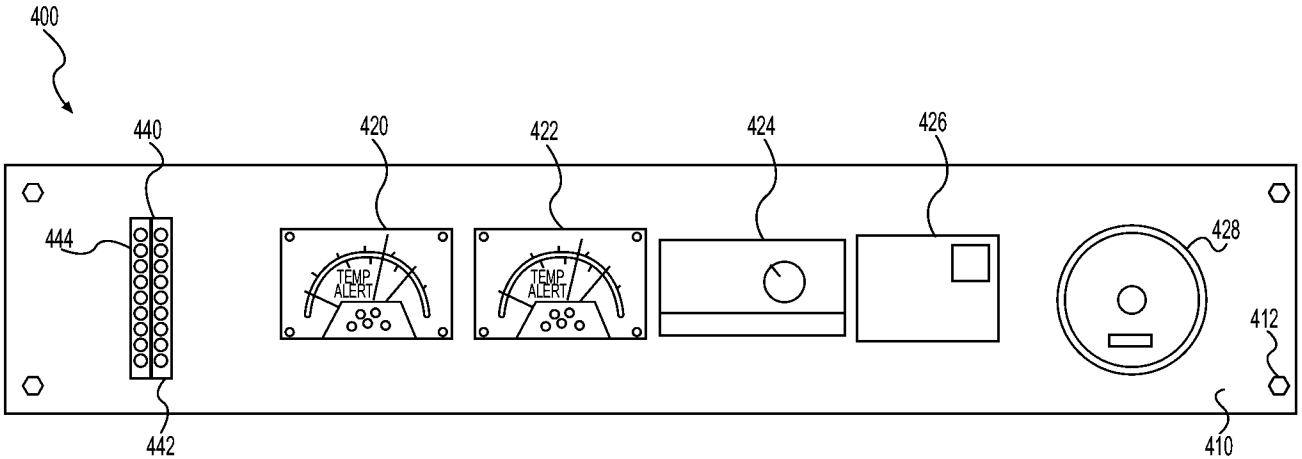
FIG. 2 is a front view of an environmental alert sensor panel in an environmental monitoring system according to one embodiment of the invention.
Figure 3:
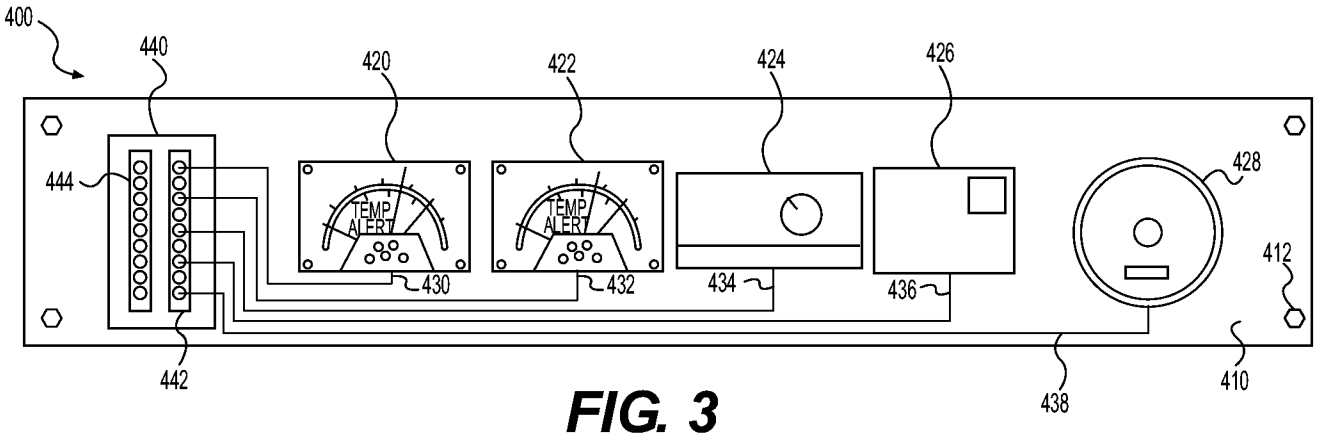
FIG. 3 is a schematic view showing the connectivity of alert sensors in the telecommunication cable station according to one embodiment of the invention.
Figure 5:
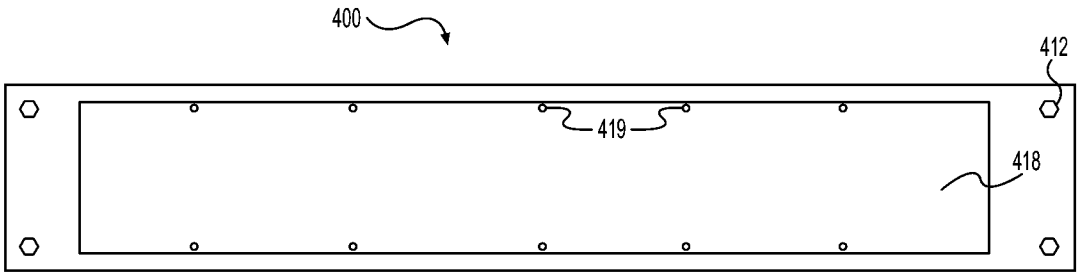
FIG. 5 is a rear view of an alert sensor panel, wherein the rear door is attached to the panel according to one embodiment of the invention.
Figure 6B:
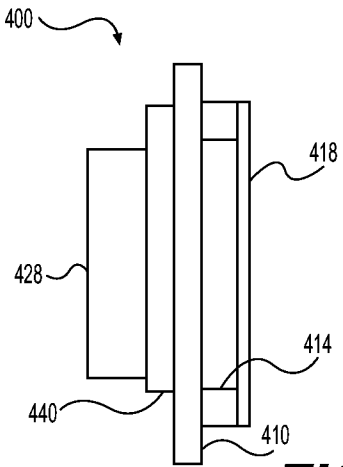
FIG. 6B is a second side view of an alert sensor panel, opposite the view of FIG. 6A, wherein the panel is fully assembled according to one embodiment of the invention.
Figure 6A:
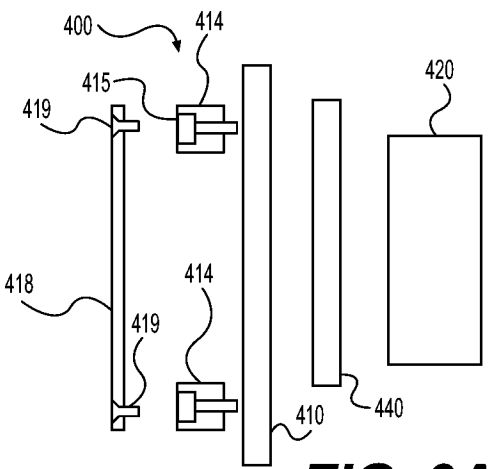
FIG. 6A is an exploded first side view of an alert sensor panel according to one embodiment of the invention.

As shown in FIGS. 2, 3 and 5, the sensor panel 400 includes a substantially flat base panel member 410 having mounting holes 412, sensors 420, 422, 424, 426, 428 mounted on a front surface of the base panel member 410 and a wire terminal block 440 mounted on the base panel member 410. Referring to FIGS. 6A and 6B, the sensors 420, 422, 424, 426, 428 and wire terminal block 440 can be mounted on the base panel member 410 with screws, pins or other fastening means (not shown). The base panel member 410 can be constructed of any suitably rigid material. However, it is preferable that the base panel member 410 be constructed of a material that is resistant to environmental elements and will not corrode or rust. According to an embodiment, the base panel member 410 is constructed of a marine grade polymer such as King Starboard Marine Grade Polymer. The sensor panel 400 can be mounted on a wall or equipment rack (not shown) of the equipment room 300 using fasteners (not shown) such as screws, bolts, nails or pins inserted through the mounting holes 412. Alternatively, if the equipment room 300 is enclosed by a cage (not shown), the sensor panel 400 can be mounted on the cage using straps or chains (not shown) inserted through the mounting holes 412.

Figure 4:
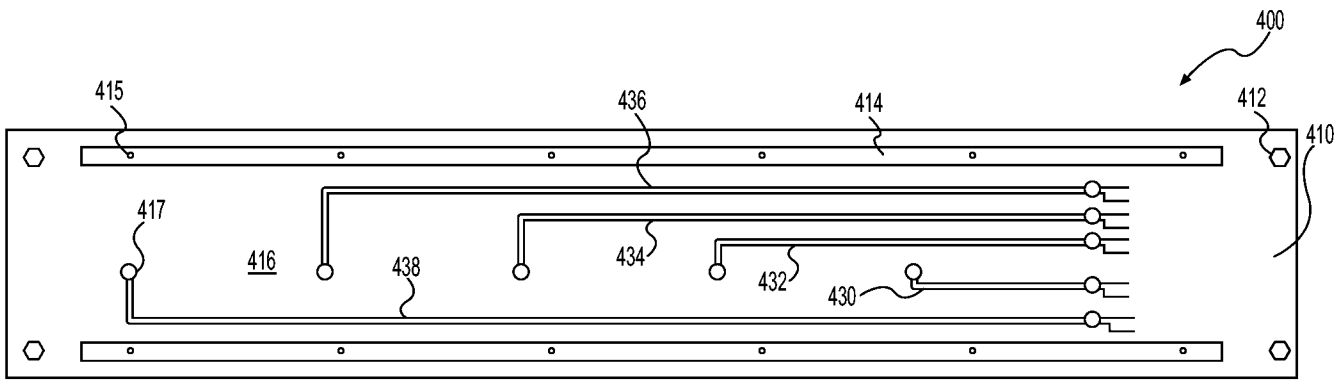
FIG. 4 is a rear view of an alert sensor panel, wherein a rear door of the alert sensor panel is removed according to one embodiment of the invention.

As shown in FIGS. 4, 6A and 6B, a pair of spaced apart, elongate rails or blocks 414 are positioned on the rear face of the base panel member 410. The blocks 414 can be constructed of a marine grade polymer such as King Starboard Marine Grade Polymer, or another suitable material, and can be attached to the base panel member 410 with screws or nails 415. Alternatively, the blocks 414 can be integrally formed (e.g., molded or fused) with the base panel member 410. The blocks 414 define a wire chase or wire channel 416 in a space between the blocks 414. As shown in FIG. 5, a rear door 418 can be mounted on the blocks 414 using removable fasteners 419 such as screws, pins or clips such that the rear door 418 is spaced from the base panel member 410 and at least partially covers the wire channel 416. Preferably, the rear door 418 substantially covers the wire channel 416. The rear door 418 can be constructed of the same material as the base panel member 410 and blocks 414, or the rear door 418 can be constructed of a different material.

Referring to FIGS. 3 and 4, the sensors 420, 422, 424, 426, 428 are in electrically conductive communication with the wire terminal block 440 by wired connections. The wire terminal block 440 can be, for example, a 12 gang anchor pin terminal block. However, other types of wire terminal blocks can be used. The sensors 420, 422, 424, 426, 428 may be connected to respective wire terminals of a first terminal bank 442 of the terminal block 440 by respective pairs of wires 430, 432, 434, 436, 438, which may be constructed of copper, gold or any other suitable electrically conductive material. The wires 430, 432, 434, 436, 438 extend from respective sensors 420, 422, 424, 426, 428 through respective holes 413 in the base panel member 410 and into the wire channel 416. The wires extend through the channel 416 and pass from the rear side of the base panel member 410 to the first wire terminal bank 442 through holes 417 in the base panel member 410. When the rear door 418 is mounted on the base panel member 410, the wires 420, 422, 424, 426, 428 are substantially covered by the rear door 418 such that they are mostly protected from physical damage and damage from the elements. The rear door 418 can be easily removed when it is desired to have full access to the wires 420, 422, 424, 426, 428.

A second terminal bank 444 of the terminal block 440 includes wire terminals in electrically conductive communication with respective wire terminals of the first terminal bank 442, and is connected to the equipment interface panel 320 by respective pairs of copper wires 450, 452, 454, 456, 458. Thus, a wired electrical connection is established between the sensors 420, 422, 424, 426, 428 and the equipment interface panel 320, thereby allowing the sensors 420, 422, 424, 426, 428 to communicate with the NOC 500, as described later in more detail.

Referring to FIGS. 1-3, the sensors 420, 422 are first and second temperature alert sensors, respectively, that sense the temperature of the equipment room 300 and generate alert signals upon sensing high or low temperature breaches (e.g., room temperatures higher or lower than acceptable according to warranty terms for the telecommunication equipment 310). The first and second temperature alert sensors 420, 422 can be passive, dry contact sensors including contacts that close a circuit when the sensed temperature reaches upper or lower set point temperatures (which can be set by a user), thereby generating alert signals. An example of a suitable dry contact temperature alert sensor is the Temp Alert® Model TA-1 temperature alert sensor, manufactured by Winland Electronics, Inc. of Mankato Minn. It should be understood, however, that other types of temperature alert sensors can be used.

According to an embodiment, the first temperature alert sensor 420 generates a first temperature alert signal when the temperature of the equipment room 300 is outside of a first selected temperature range (defined by a first lower set point temperature and a first upper set point temperature) that is determined to be acceptable for operation of the telecommunication equipment 310. Similarly, the second temperature alert sensor 422 generates a second temperature alert signal when the temperature of the equipment room 300 is outside of a second selected temperature range (defined by a second lower set point temperature and a second upper set point temperature). The first and second temperature alert signals are electrical signals transmitted to the equipment interface panel 320, and can be accompanied by audio/visual alerts generated by one or more devices in the sensors 420, 422.

In most cases, temperature breaches in TCS equipment rooms will be high temperature breaches in which the temperature of the equipment room exceeds one or more upper limit temperatures. With this in mind, according to a further embodiment, the temperature alert sensors 420, 422 can be configured such that the second upper set point temperature of the second temperature alert sensor 422 is higher than the first upper set point temperature of the first temperature alert sensor 420. Therefore, the second temperature alert signal generated by the second temperature alert sensor 422 would be a more serious alert than the first temperature alert signal generated by the first temperature alert sensor 420. According to yet a further embodiment, the first upper set point temperature could be selected to correspond to a temperature below a maximum allowable temperature under the warranty terms for the equipment 310, and the second upper set point temperature could be selected to correspond to the maximum allowable temperature under the warranty terms for the equipment 310. Thus, the first temperature alert signal could serve as an advance warning to help prevent a potential breach of warranty.

It should be understood that, although the embodiments shown and described herein include two temperature alert sensors 420, 422, it is possible for the sensor panel 400 to have only one temperature alert sensor. The sensor panel 400 can also have more than two temperature alert sensors.

Still referring to FIGS. 1-3, the sensor 424 is a humidity alert sensor that senses the humidity of the equipment room 300 and generates an alert signal upon sensing high or low humidity breaches (e.g., room humidity higher or lower than acceptable according to warranty terms for the telecommunication equipment 310). The humidity alert signal is an electrical signal transmitted to the equipment interface panel 320, and can be accompanied by an audio/visual alert generated by one or more devices in the humidity alert sensor 424. The humidity alert sensor 424 can be a passive, dry contact sensor including contacts that close a circuit when the sensed humidity is outside of a selected humidity range (defined by a lower set point humidity and an upper set point humidity, which can be set by a user), thereby generating a humidity alert signal. An example of a suitable dry contact humidity alert sensor is the Humid Alert® Model HA-1 humidity alarm sensor, manufactured by Winland Electronics, Inc. It should be understood, however, that other types of humidity alert sensors can be used.

Although a single humidity alert sensor 424 is shown and described, it is possible to employ more than one humidity alert sensor. In most cases, humidity breaches in TCS equipment rooms will be high humidity breaches in which the temperature of the equipment room exceeds an upper limit humidity. Therefore, it could be desirable to employ two humidity alert sensors with different upper set point humidities, in a way similar to the way the first and second temperature alert sensors 420, 422 are employed.

Referring again to FIGS. 1-3, the sensor 426 is a power alert sensor. The power alert sensor 426 detects a power source (not shown) for the telecommunication equipment 310 coming on or going off and can be configured to generate a power alert signal upon detecting the power source coming on and/or going off. The power alert signal is an electrical signal transmitted to the equipment interface panel 320, and can be accompanied by an audio/visual alert generated by one or more devices in the sensor 426. Thus, the power alert sensor 426 can indicate changes in the status of the power source, such as power surges or sudden losses of power that can damage the telecommunication equipment 310, or that could be symptomatic of damaging events that have transpired and may have compromised the equipment 310. The power alert sensor 426 can be, for example, a switch sensor with its own power adapter for use on any power outlet, power bar, rack or UPS. The AVTECH Power Sensor RMA-PS1-SEN supplied by AVTECH Software, Inc. of Warren, R.I. is an example of a suitable power alert sensor.

Still referencing FIGS. 1-3, the sensor 428 is a smoke alert sensor. The smoke alert sensor 428 detects smoke or fire in real-time and generates a smoke alert signal upon detecting smoke or fire. The smoke alert signal is an electrical signal transmitted to the equipment interface panel 320 and can be accompanied by an audio/visual alert generated by one or more devices in the sensor 428. The smoke alert sensor 428 can be battery powered or AC powered with a battery backup. An example of a suitable smoke alert sensor is the AVTECH Smoke Sensor RMA-SS1-SEN supplied by AVTECH Software, Inc.

While the sensor panel 400 is shown and described as having sensors 420, 422, 424, 426, 428, it should be understood that other configurations, types and numbers of sensors are possible.

As previously stated, and as illustrated schematically in FIG. 1, the NOC 500 maintains communication with the TCS 200, particularly the equipment room 300, to monitor the operation of the telecommunication equipment 310. Monitoring of the equipment room 300 is accomplished by monitoring equipment 502 in the NOC 500, which is connected to the equipment interface panel 320 by the remote connection 322. The monitoring equipment 502 can include programmable computer hardware that implements monitoring software enabling reception and detection of various alert signals and status signals from the equipment interface panel 320. Alternatively, the monitoring equipment can include one or more preprogrammed electronic devices or other electronic devices that enable reception and detection of various alert signals and status signals from the equipment interface panel 320 in a known manner. The monitoring equipment 502 receives status and alert signals from the equipment interface panel 320 and generates and records various alarms when appropriate. In this way, the sensor panel 400, equipment interface panel 320 and monitoring equipment 502 form a monitoring system for monitoring the environment of the equipment room 300 as well as various functions of the telecommunication equipment 310.

In the embodiment shown in FIG. 1, the monitoring equipment 502 includes a first computer or electronic device 510 specially programmed to monitor the temperature of the equipment room 300, a second computer or electronic device 520 specially programmed to monitor the humidity of the equipment room 300, a third computer or electronic device 530 specially programmed to monitor the on/off status of a power supply for the telecommunication equipment 310 and a fourth computer or electronic device 540 specially programmed to monitor smoke or fire in the equipment room 300. Although multiple devices 510, 520, 530, 540 are disclosed, it should be understood that the features and functions of the devices 510, 520, 530, 540 can be integrated into fewer devices or a single device.

The device 510 is configured to receive the first and second temperature alert signals generated by the first and second temperature alert sensors 420, 422 and transmitted by the equipment interface panel 320. The device 510 generates first and second temperature alarms upon receiving the first and second temperature alert signals, respectively, with the second temperature alarm being a more severe alarm according to a preferred embodiment. The devices 520, 530, 540 are configured to receive the humidity alert signal, the power alert signal and the smoke alert signal, respectively, which are respectively generated by the humidity alert sensor 424, the power alert sensor 426 and the smoke alert sensor 428, and are transmitted by the equipment interface panel 320. Upon receiving respective alert signals from the sensors 424, 426, 428, the devices 520, 530, 540 generate a humidity alarm, a power alarm and a smoke alarm, respectively. The first and second temperature alarms, humidity alarm, power alarm and smoke alarm generated by the devices 510, 520, 530, 540 can each be audio and/or visual alarms respectively indicating a temperature breach, a humidity breach, the power source coming on or going off, and the presence of smoke or fire. These alarms can be broadcasted in the NOC 500 and can also be transmitted to the TCS 200 via the remote connection 322 for broadcasting in the TCS 200. The alarms can also be recorded on recordable media or data storage drives in the TCS 200, NOS 500 and/or other locations, and can further be transmitted to warrantors of the equipment 310.

As can be appreciated from the foregoing disclosure, the systems, devices and methods disclosed herein provide a simple, cost-effective way to monitor and record environmental conditions and events in equipment rooms of telecommunication cable stations. The novel sensor panel 400 disclosed herein can be integrated with existing hardware and software in cable stations and network operating centers, with little to no modifications of such hardware and software. The sensor panel 400 is further advantageous in that it employs cost-effective sensors and low-cost, reliable wire connections, thereby eliminating the need for more expensive, complex sensors and complex, less reliable wireless interfaces between the sensors and monitoring devices. It should be understood that, where necessary, the monitoring equipment and other elements discussed herein may include one or more memories and/or processors or some combination of the two for storing instructions for implementing monitoring features and functions as well as other features and functions discussed above.

It should be apparent that the foregoing describes only selected embodiments of the invention, and numerous changes and modifications may be made to the embodiments disclosed herein by one of ordinary skill in the art without departing from the general spirit and scope of the invention as defined by the following claims and equivalents thereof.

I claim:

1. A monitoring system for a telecommunication cable station, comprising:

an environmental alarm sensor panel located in the telecommunication cable station, the environmental alarm sensor panel comprising a base panel member and a plurality of sensors mounted on the base panel member, the plurality of sensors comprising a first dry contact temperature alert sensor configured to measure an environmental temperature of an equipment room in the telecommunication cable station and generate a first temperature alert signal when the environmental temperature is outside of a first selected temperature range, a dry contact humidity alert sensor configured to measure an environmental humidity of the equipment room and generate a humidity alert signal when the environmental humidity is outside of a selected humidity range, and a dry contact smoke alert sensor configured to sense smoke and fire in the equipment room and generate a smoke alert signal upon sensing the smoke or fire; and monitoring equipment in communication with the plurality of sensors and located in a network operation center remote from the telecommunication cable station, the monitoring equipment being configured to generate a first temperature alarm, a humidity alarm and a smoke alarm in response to receiving the first temperature alert signal, the humidity alert signal and the smoke alert signal, respectively.

2. The monitoring system according to claim 1, comprising an equipment interface panel in the telecommunication cable station, wherein:

the equipment interface panel is in wired communication with telecommunication equipment in the equipment room, and the monitoring equipment is in communication with the equipment interface panel for monitoring the telecommunication equipment; and the plurality of sensors is in wired communication with the equipment interface panel for communication with the monitoring equipment.

3. The monitoring system according to claim 2, wherein:

the alarm sensor panel comprises a wire terminal block including a first bank of wire terminals and a second bank of wire terminals connected to the first bank of wire terminals;

the plurality of sensors is connected to the first bank of wire terminals by a first set of wires; and the second bank of wire terminals is in electrically conductive communication with the equipment interface panel by a second set of wires.

4. The monitoring system according to claim 1, wherein:

the plurality of sensors comprises a power alert sensor configured to generate a power alert signal indicating a power source coming on or going off; and the monitoring equipment is configured to generate a power alarm in response to receiving the power alert signal.

5. The monitoring system according to claim 1, wherein:

the plurality of sensors comprises a second dry contact temperature alert sensor configured to measure the environmental temperature and generate a second temperature alert signal when the environmental temperature is outside of a second selected temperature range; and the monitoring equipment is configured to generate a second temperature alarm in response to receiving the second temperature alert signal.

6. The monitoring system according to claim 1, wherein the monitoring equipment comprises programmable computer hardware or preprogrammed electronic hardware.

7. The monitoring system according to claim 1, wherein the alarm sensor panel comprises:

a wire channel formed on a rear side of the base panel member and accommodating wires connected to the plurality of sensors; and a removable door at least partially covering the wire channel.

8. The monitoring system according to claim 1, wherein the base panel member is constructed of a marine grade polymer material.

9. The monitoring system according to claim 1, wherein the alarm sensor panel is mounted on a wall, rack or cage of the equipment room.

10. A method of monitoring an environment of an equipment room in a telecommunication cable station, comprising:

measuring a temperature of the room using at least one dry contact temperature sensor mounted on an alarm sensor panel;

measuring a humidity of the room using a dry contact humidity sensor mounted on the alarm sensor panel;

sensing air in the room to detect fire or smoke using a smoke sensor mounted on the alarm sensor panel;

sensing the status of a power source for telecommunication equipment in the room using a power alert sensor mounted on the alarm sensor panel;

generating at least one alert signal from the alarm sensor panel in response to the temperature of the room being outside of at least one selected temperature range, the humidity of the room being outside of a selected humidity range, the presence of smoke or fire in the room, and/or the power source coming on or going off;

detecting the at least one alert signal using monitoring equipment in a network operation center located remotely from the telecommunication cable station; and generating at least one alarm from the monitoring equipment in response to the at least one alert signal, the at least one alarm including an indication that the temperature of the room is outside of at least one selected temperature range, the humidity of the room is outside of a selected humidity range, smoke or fire is present in the room, and/or the power source has come on or gone off.

11. The method according to claim 10, wherein:

the telecommunication cable station includes an equipment interface panel in wired communication with telecommunication equipment in the room, and in communication with the monitoring equipment; and the at least one temperature alert sensor, the humidity alert sensor, the smoke alert sensor and the power alert sensor are in wired communication with the equipment interface panel for communication with the monitoring equipment.

12. The method according to claim 11, wherein:

the alarm sensor panel comprises a wire terminal block including a first bank of wire terminals and a second bank of wire terminals connected to the first bank of wire terminals;

the at least one temperature alert sensor, the humidity alert sensor, the smoke alert sensor and the power alert sensor are connected to the first bank of wire terminals by a first set of wires; and the second bank of wire terminals is connected to the equipment interface panel by a second set of wires.

13. The method of claim 10, wherein the alarm sensor panel is mounted on a wall, rack or cage of the equipment room.

* * * * *